United States Patent [19]

Rowley

[11] 3,964,608

[45] June 22, 1976

[54] ADJUSTABLE BACK SUPPORT FOR SHIPPING BINS

[75] Inventor: James R. Rowley, Freeport, Pa.

[73] Assignee: PPG Industries, Inc., Pittsburgh, Pa.

[22] Filed: July 15, 1974

[21] Appl. No.: 488,347

[52] U.S. Cl. ..... 206/451; 105/489; 206/454; 214/10.5 R

[51] Int. Cl.[2] ..... B65D 85/48

[58] Field of Search ..... 105/467, 489–495; 206/448–454; 211/41, 49 R; 214/6 D, 7, 10.5 R; 217/53; 248/119 R

[56] References Cited

UNITED STATES PATENTS

| | | | |
|---|---|---|---|
| 1,165,163 | 12/1915 | Evans | 105/495 |
| 1,813,269 | 7/1931 | Barrett | 105/495 |
| 3,200,772 | 8/1965 | Moorhead | 105/495 |
| 3,345,955 | 10/1967 | Erickson | 105/495 |
| 3,590,746 | 7/1971 | Gibson | 105/495 |
| 3,791,311 | 2/1974 | Loomis | 105/491 |
| 3,809,234 | 5/1974 | Kurick | 206/451 X |

*Primary Examiner*—Steven E. Lipman
*Attorney, Agent, or Firm*—Donald Carl Lepiane

[57] ABSTRACT

An article shipping bin has an adjustable back support that includes a pair of struts each pivotally mounted at a first end to a rigid plate and at their second end to the back wall of the bin. Adjusting the struts such that the distance between the first end of the struts is less than the distance between the second end of the struts provides (1) an angle of tilt to the articles for packing stability and to cancel small swaying forces acting on the articles during shipment thereof and (2) stability to the back support.

9 Claims, 3 Drawing Figures

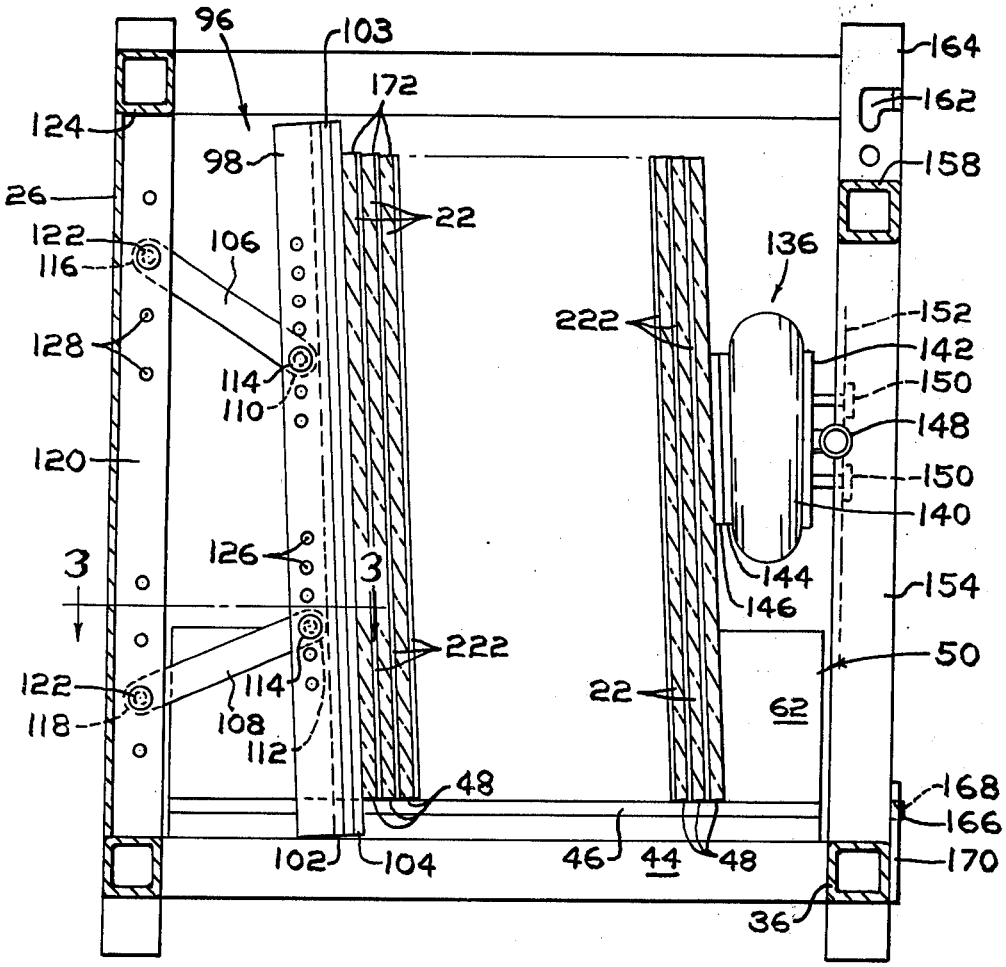
FIG. 2
FIG. 3
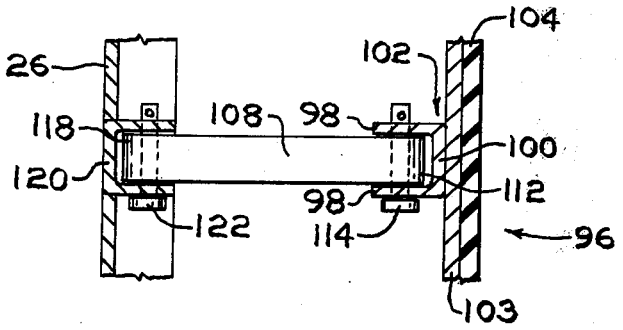

ADJUSTABLE BACK SUPPORT FOR SHIPPING BINS

CROSS REFERENCE TO RELATED APPLICATIONS

The end restraint system disclosed in U.S. Patent Application Ser. No. 488,346 filed even date in the name of James R. Rowley and entitled "End Restraints for Shipping Bins" may be used with the adjustable back support of the invention. The front restraint devices disclosed in U.S. Pat. Application Ser. No. 488,851 filed even date in the names of Walter E. Pater and James R. Rowley and entitled "Front Restraint Device For Shipping Bins" and in U.S. Pat. Application Ser. No. 371,912 filed June 20, 1973, in the names of James R. Rowley and Walter E. Pater and entitled "Method of and Device for Restraining Movement of Articles During Transit" may be used with the adjustable back support of the invention. The teachings of the above-mentioned applications are hereby incorporated by reference.

BACKGROUND OF THE INVENTION

1. Field of the Invention

This invention relates to an adjustable back support for bins of the type used to ship articles, e.g., glass sheets, automotive backlites, automotive windshields or automotive sidelights.

2. Discussion of the Technical Problems

Articles, e.g., glass sheets, automotive backlites, automotive windshields or automotive sidelights, are normally shipped to automotive manufacturers in bins or racks.

During shipment, e.g., by rail car or truck, the articles in the bins are subjected to transportation forces. For example, the articles are subjected to (1) oscillatory forces which tend to move the articles about a pivot point toward and away from the back wall of the bin, i.e., along an oscillatory reciprocating path; and (2) lateral forces which tend to move the articles toward and away from the back wall of the bin, i.e., along a lateral reciprocating path.

These forces which act on the articles are caused by the motion of the rail car or truck as it moves along the rails or road respectively. As can be appreciated by those skilled in the art, these transportation forces can damage the articles, especially glass, during transit making them unusable.

In general, to prevent damage to the articles, e.g., automotive backlites, during shipping, the backlites are normally loaded in a bin in a vertical position with an edge of the backlites resting on a resilient pad and tilted toward the back wall of the bin for packing stability. A front restraint device is mounted at the ingress end of the bin to maintain the backlites against the back support and to unitize the backlites.

The tilting of the backlites facilitates loading of the backlites into the bin and also tends to reduce the oscillatory motion of the backlites during shipment. More particularly, because the articles are on one edge tilted toward the back wall, a greater oscillatory force has to be applied to oscillate the backlites about the bottom edge thereby canceling out small swaying motions of the rail car or truck.

In the prior art, bins used for transporting automotive backlites are provided with a wedged shaped member positioned in the back of the bin to provide a tilt to the backlites. This is undesirable for several reasons; namely, (1) when the bin is unloaded, the wedged shaped member has to be disposed of creating a solid waste problem; and (2) for partial loads and different curvature of backlites, it is required to have on hand different shaped wedge members thereby requiring different members to be made and stored.

It would be advantageous, therefore, if a bin for shipping articles is available that did not have the drawbacks or limitations of the prior art. More particularly, it would be advantageous to provide a bin with a back support that is adjustable to accommodate backlites of different curvature and does not create a solid waste disposal problem.

SUMMARY OF THE INVENTION

This invention relates to an adjustable back support for supporting at least one article on an edge. The back support includes a first rigid member mounted in a vertical positions and a second rigid member. facilities are provided for mounting maintaining facilities to the first and second rigid members. The maintaining facilities maintain the first and second rigid members in spaced relation. Facilities are provided for providing stability to the second rigid member.

In one embodiment, the first rigid member is a back wall of a bin. A first strut and a second strut have an end pivotally mounted to the second rigid member and the other end of the struts pivotally mounted to the back wall of the bin. To provide stability to the second rigid member, the distance between the struts at the back wall is greater than the distance between the struts at the second rigid member.

This invention also relates to a method of fabricating a back support for at least one article. A first and second strut have one end mounted to a first rigid member mounted in a vertical position, e.g., a back wall of a bin. The other end of the struts is mounted to a second rigid member. The struts and rigid members are arranged to form a frustrum of a triangle to give the second rigid member stability.

BRIEF DESCRIPTION OF THE DRAWING

FIG. 2 is a cross-sectional side view of the bin of FIG. 1 loaded with automotive backlites; and FIG. 3 is a view taken along lines 3—3 of FIG. 2 and having portions removed for purposes of clarity showing the adjustable back support incorporating features of the invention.

DESCRIPTION OF THE INVENTION

Figure 1:
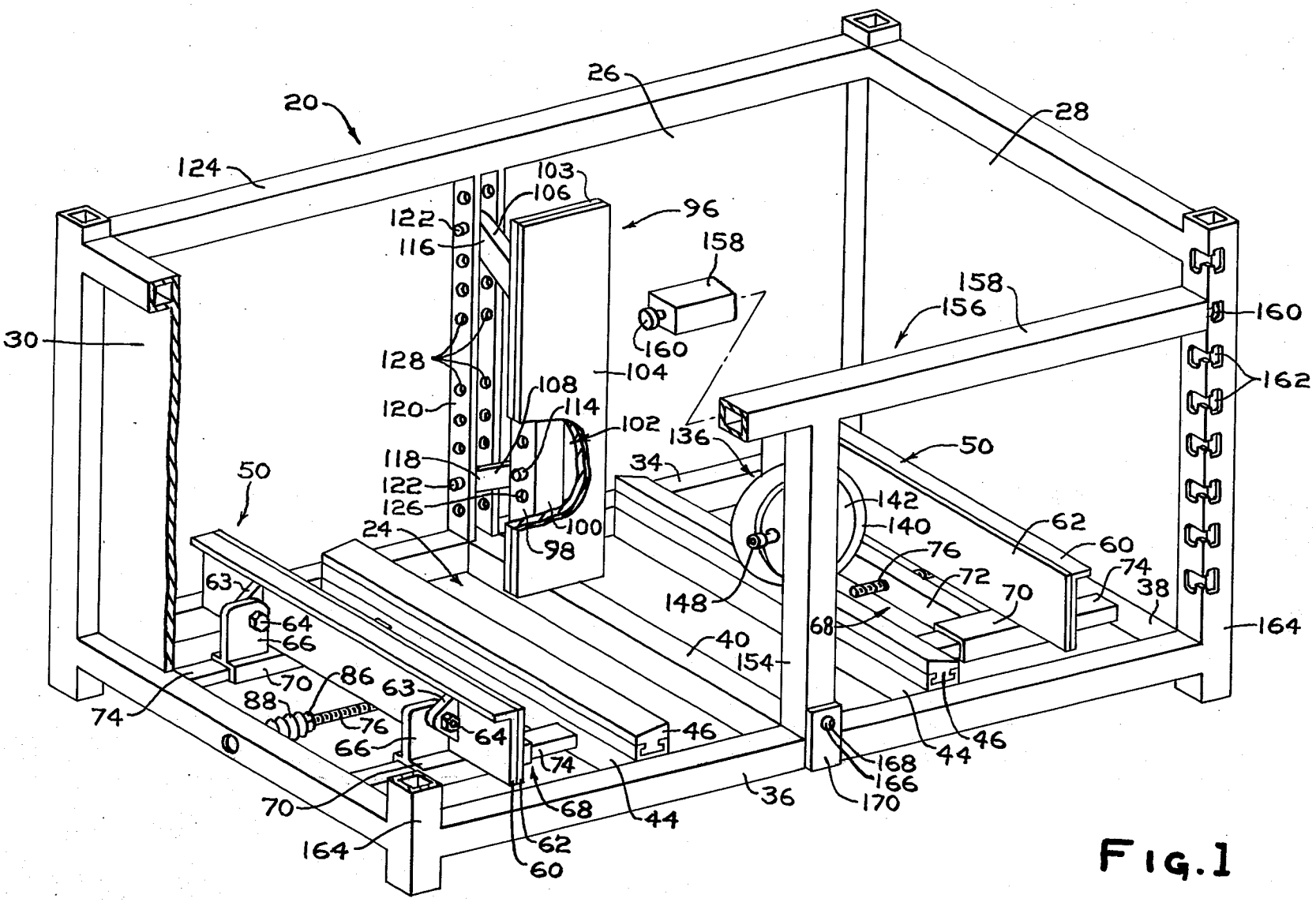
FIG. 1 is an isometric view of a bin having portions removed for purposes of clarity and having a back support incorporating features of the invention.

In general, this invention relates to a back support that may be used with article shipping bins. Referring to FIG. 1, there is shown a bin 20 used for transporting articles 22 (shown in FIG. 2) for example, glass plates, automotive backlites, automotive sidelights, or automotive windshields incorporating features of the invention. In general, the bin 20 includes a base 24, a back wall 26, a right and left sidewall 28 and 30 respectively as viewed in FIG. 1 secured together to define the bin 20 having an ingress end.

Certain terms which will be used herein are now defined for purposes of clarity. "Longitudinal motion of the articles" as the term is used herein, is the motion of the articles along a longitudinal reciprocating path.

"Longitudinal reciprocating path" as the term is used herein is the motion of the articles toward and away from the sidewalls of the bin. "Longitudinal forces" as the term is used herein are the forces acting on the articles which impart longitudinal forces to the articles to move them along the longitudinal reciprocating path. "Oscillatory motion of the articles" as the term is used herein is the motion of the articles along an oscillatory reciprocating path. "Oscillatory reciprocating path" as the term is used herein is a path subtended by the articles as they pivot about a bottom edge toward and away from the back wall of the bin. "Oscillatory forces" as the term us used herein are the forces acting on the articles which impart oscillatory forces to the articles to move them along the oscillatory reciprocating path. "Lateral motion of the articles" as the term is used herein is the motion of the articles along a lateral reciprocating path. "Lateral reciprocating path" as the term is used herein is the motion of the articles toward and away from the back wall of the bin. "Lateral forces" as the term is used herein are the forces acting on the articles which impart lateral forces to the articles to move then along the lateral reciprocating path.

The longitudinal, lateral and oscillatory forces are generated by the acceleration, deceleration or swaying motion of the truck or rail car.

The base 24, in general, is defined by a pair of spaced rigid longitudinal members 34 and 36 interconnected to a right lateral member 38, a center lateral member 40, and a left lateral member 42. A pair of stationary runners 44 each having a resilient pad 46 for supporting the articles on an edge 48 (shown in FIG. 2) is secured between the longitudinal members 34 and 36. An end restraint 50 is provided adjacent eacn one of the sidewalls 28 and 30 for engagement with the sides of the articles (see FIG. 2) to prevent or minimize longitudinal motion and to dampen longitudinal forces of the articles during transit.

As will be appreciated, the invention is not limited to the type of end restraints employed to prevent longitudinal motion and dampen longitudinal forces of the articles during transit.

Disclosed in U.S. Pat. Application Ser. No. 488,346 filed even date in the name of James R. Rowley and entitled "End Restraint System for Shipping Bins" there is disclosed an end restraint that may be used in the practice of the invention.

In general, and with continued reference to FIG. 1, the end restraint 50 on the right and left side of the bin as viewed in FIG. 1 are identical in construction; therefore, the end restraint at the left side of the bin 20 as viewed in FIG. 1 will be discussed for purposes of simplicity with the understanding that the discussion is also applicable to the end restraint at the right side of the bin unless indicated otherwise.

The end restraint 50 includes a rigid inverted L-shaped plate 60 having a resilient pad 62 on one surface. A pair of spaced plates 63 are provided on the opposed surface to pivotally mount the plate 60 at 64 to each one of a pair of uprights 66 of a movable carriage 68. The plate 60 is pivotally mounted to seat against the sides of the articles. The resilient pad 62 prevents marring of the sides of the articles (see FIG. 2).

The carriage 68 further includes a pair of sleeves 70 securely connected to the uprights 66 and interconnected by a rigid member 72. The sleeves are mounted on guide rails 74 to permit movement of the carriage 68 and end restraint toward and away from the sides of the articles. A threaded shaft 76 has one end freely mounted in adjacent lateral member 42 and the other end threaded into the cross member 72 in any conventional manner. Rotating the shaft in a first direction moves the carriage and end restraint toward the sides of the articles and rotating the shaft in a second direction moves the carriage and end restraint away from the sides of the articles along the guide rails.

A plurality of disc springs 88 are provided on the shaft 76 between nut 86 and cross member 42 to provide facilities to (1) bias the end restraint toward the sides of the articles 22 (see FIG. 2) to prevent longitudinal motion of the articles during transit and; (2) dampen longitudinal forces of the articles during transit.

With reference to FIG. 2, the articles 22 are tilted toward the back wall 26 to (1) provide packing stability; (2) to minimize swaying, e.g., small oscillatory forces imparted to the articles during transit and (3) to dampen oscillatory and lateral forces acting on the articles 22.

With reference to FIGS. 1, 2 and 3, there is shown an adjustable back support 96 incorporating features of the invention. The back support or member 96 includes a pair of rigid plates 98 interconnected to a third rigid plate 100 to form a generally U-shaped member 102 (shown better in FIG. 3). A rigid plate 103 is securely joined to the plate 100 of the U-shaped member 102 in any conventional manner, e.g., by welding. A resilient pad 104 is advantageously secured to outer surface of the plate 103 to prevent marring of the surface of the article in contact therewith and to dampen oscillatory and lateral forces of the articles as the articles move toward the back wall of the bin. A top strut 106 and a bottom strut 108 are each pivotally mounted at one end 110 and 112 respectively to the plates 98 by way of pins 114. Each strut 106 and 108 is mounted at their other end 116 and 118 respectively to a U-shaped channel member 120 by way of pins 122.

With reference to FIGS. 1 and 2, longitudinal U-shaped channel member 120 is securely mounted between the longitudianl member 34 and longitudinal member 124 of the back wall 26. To accommodate different article configurations and for packing stability, the plates 98 and U-shaped channel member 120 are advantageously providing with a plurality of holes 126 and 128 respectively. To prevent the back support member 96 from collapsing, it is recommended that (1) the U-shaped channel member 120; (2) U-shaped member 102 and (3) the struts 106 and 108 form a frustrum of a triangle as illustrated in FIG. 2 with the bottom end of the rigid plate 103 resting on the center lateral member 40 as shown in FIG. 1. More particularly, the distance between ends 110 and 112 of the struts 106 and 108, respectively, is less than the distance between ends 116 and 118 of the struts 106 and 108, respectively. The distance between the ends is not limiting to the invention.

By selectively positioning the struts 106 and 108, the back support member 96 may be (1) tilted at any angle to support the articles; and (2) spaced at any lateral distance from the back wall to accommodate partial loads and accommodate various article patterns. Preferably, the angle ot tilt is approximately 5° from a line normal to the base 24 of the bin 20.

A front restraint device 136 cooperates with the back support member 96 to (1) secure the articles in the bin as a unitized pack; (2) limit oscillatory and lateral motions of the articles during transit and (3) dampen oscillatory and lateral forces of the articles as the articles move along the oscillatory and lateral paths during transit.

The front restraint device may be of the type known in the art, e.g., the restraint device disclosed in U.S. Pat. Application Ser. No. 371,912 filed on June 20, 1973, in the names of James R. Rowley and Walter E. Pater and entitled "Method of and Device for Restraining Movement of Articles During Transit" or of the type disclosed in U.S. Pat. Application Ser. No. 488,851 filed even date in the names of Walter E. Pater and James R. Rowley and entitled "Front Restraint Device for Shipping Bins." Shown in FIGS. 1 and 2 is the pneumatic front restraint device disclosed in the above-mentioned U.S. Pat. Application Ser. No. 488,851 filed even date.

In general, and with reference to FIGS. 1 and 2, the pneumatic restraint device 136 includes an inflatable member 140 having a rigid pad 142 on one surface and a rigid pad 144 advantageously mounted on the opposite surface of the inflatable member. The rigid pad 144 which is moved into engagement with the articles when the member 140 is inflated, is provided with a resilient pad 146 to prevent marring of the article surface in contact therewith. The inflatable member 140 is inflated and deflated by way of a valve 148 which is advantageously mounted on a rigid pad 142.

With reference to FIG. 2, the pneumatic restraint device 136 is mounted at the ingress end of the bin 20 by providing a pair of headed studs 150 on the rigid pad 142 of the restraining device 136. The studs 150 are advantageously slidably mounted in groove 152 provided on leg 154 of a T-shaped member 156 (see also FIG. 1). As shown in FIG. 1, the T-shaped member 156 may be secured at the ingress end of the bin by providing a headed stud 160 at the end of outer arms 158 of the T-shaped member 156 which is seated in one of a plurality of grooves 162 provided on posts or standards 164 at the ingress end of the bin 20. The leg 154 may be provided with a stud 166 which is seated in hole 168 of a plate 170 secured to the longitudinal member 36 at the ingress end of the bin 20 (see also FIG. 2).

During shipment of the articles, oscillatory and/or lateral forces move the articles along the oscillatory and/or lateral reciprocating path, respectively i.e., between the back support member 96 and the inflatable member 140. When the articles are moved against the front restraint device 136, the inflatable member 140 compresses which increases the force of the inflatable member. When the force exceeds the lateral and/or oscillatory forces the articles are moved against the back support member 96. The pad 104 of the back support member 96 absorbs the shock to dampen the oscillatory and lateral forces as the article moves toward the inflatable member 140 under the oscillatory and/or lateral forces. In this manner, the oscillatory and/or lateral forces acting on the articles are dampened to prevent damage to the articles during transit.

As can now be appreciated by those skilled in the art, the back support member can also be used on bins that are used for storing articles and on bins used to move a plurality of articles in a storage area.

DETAILED DESCRIPTION OF THE INVENTION

The invention will now be described for shipping automotive backlites 22 (see FIG. 2) made of ¼ inch (0.64 centimeters) thick tempered glass. The dimension of the bottom edge 48 is about 62 inches (158 centimeters), of the top edge 172 is about 66 inches (168 centimeters) and of the sides is about 28 inches (71 centimeters).

With reference to FIG. 1, a bin 20 has a base 24 having dimensions of 75 inches (190 centimeters) by 36 inches (91 centimeters). Right sidewall and left sidewall 28 and 30 have dimensions of 36 inches (91 centimeters) and 44 inches (112 centimeters) respectively and back wall 26 has dimensions of 75 inches (190 centimeters by 44 inches (112 centimeters). Unless indicated otherwise, all rigid members are made of hollow tubing having a wall thickness of ⅛ inch (0.32 centimeters) and a square cross-section with dimensions of 2 inches (5.08 centimeters) by 2 inches (5.08 centimeters) securely mounted together as by welding.

The base 24 includes a pair of rigid longitudinal members 34 and 36 joined to ends of rigid lateral members 38, 40 and 42. A pair of stationary runners 44 are spaced about 25 inches (63.5 centimeters) apart about the lateral member 40 of the base 24. Rubber padding 46 is secured to the runners 44 in any conventional manner.

The end restraint system disclosed in the above-mentioned U.S. Pat. Application Ser. No. 488,346 filed even date will be used to prevent longitudinal motion of the backlites and to dampen longitudinal forces acting on the articles during transit. With continued reference to FIG. 1, pair of guide rails 74 made of tubing having a ⅛ inch (0.32 centimeters) wall thickness and a square crosssection having dimensions of 2 inches (5.08 centimeters) by 2 inches (5.08 centimeters) are provided on each side of the base 24. On the right side as viewed in FIG. 1, the guide rails 74 are secured at one end to lateral member 38 and at the other end to adjacent stationary runner 44. On the left side, the guide rails 74 are secured at one and to lateral member 42 and at the other end to adjacent stationary runner 44. The guide rails 74 are spaced about 24 inches (60.5 centimeters) apart about a center line between longitudinal members 34 and 36.

The guide rails 74 support a carriage 68 for moving end restraints 50 toward and away from the side of the backlites. The right and left carriage and end restraints 50 are identical in construction. Therefore, the carriage and end restraint on the left side of the bin as viewed in FIG. 1 will be discussed with the understanding that the discussion is applicable to the carriage and end restraint on the right side unless indicated otherwise.

The carriage 68 includes a sleeve 70 slideably mounted on each of the guide rails 74 and joined together by a rigid member 72.

A steel upright 66 having a generally rectangular shape has its width edge securely mounted to each of the sleeves 70. A generally L-shaped plate 60 is provided with a pair of spaced plates 63. The spaced plates 63 are pivotally mounted to the uprights 66 at 64 as by pins so that the plate 60 fits the edge contour of the backlites. A rubber pad is provided on the plate 60 to prevent marring of the backlites.

A threaded shaft 76 has an end rotatably mounted in cross member 42 on the left side of the bin and a similar shaft 74 has an end rotatably mounted in cross member 38 on the right side of the bin. The other end of the bin is threaded in rigid member 72.

A nut 86 is secured to the shaft 74 at a point about 4 inches (10.2 centimeters) from the lateral member 42 to secure 28 disc springs on the shaft between the nut 86 and the cross-member 42. The springs are of the type sold by E. C. Styberg Engineering Co., Inc., and arranged such that each pair of springs has a concave face opposite each other to provide a bellow type spring.

One of the end restraints, e.g., the right end restraint as viewed in FIG. 1 is moved toward its adjacent runner 44 by rotating the shaft 76 in a first direction. The right end restraint is positioned about 31 inches (79 centimeters) from the center lateral member 40 to seat automotive windshields to be subsequently loaded. The left end restraint is moved away from the adjacent runner 44 by rotating the shaft in a second direction.

The back wall 26 of the bin 20 is provided with a back restraint member 96 (1) to give the articles packing stability; and (2) to absorb oscillatory and/or lateral forces as the backlites move toward the back wall of the bin during transit.

With reference to FIG. 1, 2 and 3, the back restraint member 96 includes a steel plate 103, ¼ inch (0.64 centimeters) thick, 4 inches (10.2 centimeters) wide and 36 inches (91 centimeters) in length. A ½ inch (1.3 centimeters) thick rubber pad 104 with a durometer reading of 60 is advantageously bonded to a side of the plate 103. The opposite side of the plate 103 is secured to a U-shaped member 102. The U-shaped member is ¼ inch ((0.64 centimeters) thick having legs 98 with dimensions of 1½ inches (3.8 centimeters) by 36 inches (91 centimeters) and a center leg 100 with dimensions of 1½ inches (3.8 centimeters) by 36 inches (91 centimeters) to provide a spacing between legs of about 1 inch (2.54 centimeters). A plurality of holes 126, ½ inch (1.3 centimeters) in diameter on a center to center spacing of about 1½ inches (3.8 centimeters) is provided on each of the legs 98 for pivotally mounting one end of a top strut 106 and one end of a bottom strut 108 by way of pins 114 to the U-shaped member 102.

The struts 106 and 108 are each 8 inches (20 centimeters) in length and made of steel tubing having a wall thickness of ½ inch (0.32 centimeters) and a square cross-section 1 inch by 1 inch (2.54 centimeters by 2.54 centimeters). The opposite end of each of the struts 106 and 108 is pivotally mounted to a generally U-shaped channel member 120 of the back wall 26 by way of pins 122. The U-shaped channel 120 has a wall thickness of ¼ inch (0.64 centimeters) and a spacing between the legs of 1 inch (2.54 centimeters). The U-shaped channel 120 is provided with a plurality of holes 126, ½ inch (1.3 centimeters) in diameter on a center to center spacing of 1½ inches (3.6 centimeters) to provide adjustments to the back support member 96.

The back support member 96 is arranged to provide a 5° angle of tilt from a line normal to the base 24 of the bin 20 to provide for packing stability and cancel swaying motions of the backlites. The U-shaped member 102, and the top and bottom struts 106 and 108 are arranged to provide a frustrum of a triangle configuration which gives rigidity to the back support member 96 (see FIG. 2). More particularly, the distance between ends 110 and 112 of the struts 106 and 108, respectively, is 10 inches (25.4 centimeters) and the distance between ends 116 and 118 of the struts 106 and 108, respectively, is 18 inches (45.7 centimeters). Further, the bottom end of the plate 103 as viewed in FIG. 1 rests on center lateral member 40 for further stability.

The bin is now ready for receiving the automotive backlites 22. Approximately 80 backlites are loaded in the bin on an edge 48 and separated by dimpled paper 222 (see FIG. 2) to prevent surface marring of adjacent surfaces. After the backlites are loaded, the shaft 76 of the left end restraint member 50 is rotated in a second direction to move the end restraint into contact with the sides of the backlites.

The backlites 22 will be secured in the bin with a pneumatic restraint device 136 of the type disclosed in the above-mentioned U.S. Pat. Application Ser. No. 488,851 filed even date. With reference to FIGS. 1 and 2, the pneumatic restraint device 136 includes an inflatable member 140 having a rigid pad 144 on one side and a rigid pad 142 on the other side. A valve 148 is provided on the plate 142 for inflating and deflating the member 140. Such an inflatable member may be purchased from Firestone Co., and are known as airmounts.

A rubber pad 146 is secured to the pad 144 in any conventional manner and a pair of headed studs 150 are provided on the pad 142. A generally, T-shaped member 156 having outer arms 158 and a leg 154 is provided to securely mount the pneumatic restraint device at the ingress end of the bin 20.

The leg 154 of the T-shaped member is provided on one side with a groove 152 having a width less than the head of the studs to slideably mount the pneumatic device on the leg 154. The T-shaped member 156 having the pneumatic restraint device 136 is mounted at the ingress end of the bin, by providing headed studs 160 at the ends of the outer legs 158 (shown in FIG. 1) and a stud 166 at the free end of the leg 154 (shown better in FIG. 2). The headed studs 160 are seated in grooves 162 provided in posts 164 at the ingress end of the bin and the stud 166 is mounted in the hole of a plate 170 mounted to the longitudinal member 36.

The pneumatic restraint device 136 is moved along the groove 152 until the center of resilient pad 146 is about 10 inches (25.4 centimeters) from the top edge 172 of the backlites. Air is moved into the valve to inflate the member 140 to move the pad 146 into engagement with the stack of backlites. The inflatable member is inflated to a pressure of about 40 psi. This applies a static force of about 1,200 pounds (544.32 kilograms) to unitize the backlites. In other words, the backlites respond to transportation forces as a single unit.

During transit, longitudinal forces acting on the backlites are absorbed by the end restraints 50 in the manner disclosed in the above-mentioned U.S. Pat. Application Ser. No. 488,346 filed even date. Also during shipment oscillatory forces pivot the backlites about the bottom edge 48 and lateral forces move the backlites away from the back support member 96 against the pneumatic restraint device 136. The pneumatic restraint device 136 absorbs any oscillatory forces and/or lateral forces while urging the backlites toward the back support member 96. More particularly, as the backlites respond to the oscillating and/or lateral forces, the backlites 22 move away from the back support member 96 against the pneumatic front restraint device 136. The pneumatic front restraint device dampens the oscillating and lateral forces while urging the backlites against the back support member. The resilient pad 104 of the back support member 96 absorbs the oscillatory and lateral forces to dampen the oscillatory and/or lateral motion of the backlites.

What is claimed is:

1. A back support for an article shipping bin, the bin being of the type having a backwall secured to a base, comprising:

a rigid support member;

fixed point means mounting the backwall of the bin and said rigid support member; and means for maintaining said rigid support member in spaced relation to the backwall of the bin, said maintaining means comprising:

a first strut having a first end secured to the backwall of the bin at a first one of said fixed point means and the opposite end of said first strut secured to said rigid support member at a second one of said fixed point means;

a second strut having a first end secured to the backwall of the bin at a third one of said fixed point means and the opposite end of said second strut secured to said rigid support member at a fourth one of said fixed point means; and said first and second struts in spaced relation to each other and the distance between the first and third ones of said fixed point means is different than the distance between the second and fourth ones of said fixed point means.

2. The back support as set forth in claim 1 wherein said maintaining means includes:

means for detachably securing (1) the first end of each of said first and second struts to the backwall and (2) the opposite end of each of said first and second struts to said rigid support member.

3. The back support as set forth in claim 1 wherein said rigid support member has a first surface and a second surface opposite to the first surface, further comprising:

a resilient pad mounted on the first surface of said rigid support member.

4. The back support as set forth in claim 3 wherein said fixed point means includes:

a first U-shaped channel member securely mounted to the second surface of said rigid support member;

a second U-shaped channel member vertically mounted at the backwall of the bin; and said maintaining means further comprises:

means for detachably securing the first end of said first and second struts to said second U-shaped channel member and the opposite end of said first and second struts to said first U-shaped channel member.

5. The back support as set forth in claim 4 wherein the spaced distance between the second and fourth ones of said fixed point means is less than the spaced distance between the first and third ones of said fixed point means.

6. The back support as set forth in claim 5 wherein the article shipping bin contains a plurality of glass sheets supported in the base and said rigid support member is in a generally vertical position, further including:

means for preventing movement of the glass sheets toward and away from said rigid support member; and means for preventing sideward motion of the glass sheets relative to said rigid support member.

7. The back support as set forth in claim 6 wherein the back support and an imaginary line normal to the base subtend an angle of about 5°.

8. The back support as set forth in claim 1 wherein the spaced distance between the first and third ones of said fixed point means is less than the spaced distance between the second and fourth ones of said fixed point means.

9. The back support as set forth in claim 1 wherein the shipping bin is used to ship at least one article and further includes:

means for preventing movement of the at least one article to be shipped toward and away from said rigid support member; and means for preventing sideward movement of the at least one article to be shipped relative to said rigid support member.

* * * * *

UNITED STATES PATENT OFFICE

CERTIFICATE OF CORRECTION

PATENT NO. : 3,964,608

DATED : June 22, 1976

INVENTOR(S) : James R. Rowley

It is certified that error appears in the above-identified patent and that said Letters Patent are hereby corrected as shown below:

Claim 6, line 3, "in" should be --on--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademark*